US006484536B1

(12) United States Patent
Gould

(10) Patent No.: US 6,484,536 B1
(45) Date of Patent: Nov. 26, 2002

(54) INTERLOCKING RINGS

(76) Inventor: Alan Gould, 1136 Antique La., Northbrook, IL (US) 60062

( * ) Notice: Subject to any disclaimer, the term of this patent is extended or adjusted under 35 U.S.C. 154(b) by 0 days.

(21) Appl. No.: 09/572,185

(22) Filed: May 17, 2000

(51) Int. Cl.[7] ..... A44C 19/00

(52) U.S. Cl. ..... 63/15.1; 63/15; 63/15.3; 63/15.4

(58) Field of Search ..... 63/15, 15.1, 15.2, 63/15.3, 15.4

(56) References Cited

U.S. PATENT DOCUMENTS

| | | | | | |
|---|---|---|---|---|---|
| 984,803 | A | * | 2/1911 | Dinuccio | 40/299.01 |
| 1,327,606 | A | * | 1/1920 | Bacharach | 63/15.2 |
| 1,712,417 | A | * | 5/1929 | Beaujard, Jr. | 63/15.3 |
| 1,758,447 | A | * | 5/1930 | Liebs | 63/15.1 |
| 2,016,679 | A | * | 10/1935 | Mayer | 63/15.1 |
| 2,316,225 | A | * | 4/1943 | Hoffman et al. | 63/29.1 |
| 4,226,094 | A | * | 10/1980 | Wolpoff | 63/15.4 |
| 5,076,073 | A | * | 12/1991 | Boucheron | 63/29.1 |
| 5,228,316 | A | * | 7/1993 | Meyrowitz | 63/15.4 |
| D348,022 | S | | 6/1994 | Sandberg | |
| 5,419,158 | A | | 5/1995 | Sandberg et al. | |
| 5,483,808 | A | * | 1/1996 | Barbazza | 63/15.5 |
| 5,596,887 | A | | 1/1997 | Bergagnini | |
| 5,669,241 | A | * | 9/1997 | Kohl | 63/15.2 |
| 5,735,144 | A | | 4/1998 | Gabel | |
| 5,865,042 | A | * | 2/1999 | Cerqua | 63/1.11 |
| D421,405 | S | | 3/2000 | Mestrum | |

FOREIGN PATENT DOCUMENTS

| | | | | |
|---|---|---|---|---|
| DE | 4321759 | * | 1/1995 | 63/15 |

* cited by examiner

*Primary Examiner*—J. J. Swann
*Assistant Examiner*—Andrea Chop
(74) *Attorney, Agent, or Firm*—Wallenstein & Wagner, Ltd.

(57) ABSTRACT

An item of jewelry preferably in the form of a ring having a first ring portion mechanically interconnected to a second ring portion. Preferably each ring portion includes a plurality of alternating radially inward linking segments and radially outward linking segments. The radially inward linking segments include a groove which mates with a tongue formation on the radially outward linking segments.

21 Claims, 1 Drawing Sheet

INTERLOCKING RINGS

TECHNICAL FIELD

The present invention is generally directed to an interlocking connection for two or more components of an item of jewelry, and more particularly to an interlocking connection for two or more ring portions which are combined into a single finished ring.

BACKGROUND OF THE INVENTION

There are a variety of jewelry designs which incorporate joining separate pieces into a final product. However, such designs lack the ability to provide an interconnection which permanently and mechanically links two or more pieces together.

One design for a ring is shown in U.S. Pat. No. 5,596,887 for a "Ring Remount Wrap Assembly." In this design two ring portions are configured to wrap around a central third ring portion. The ring portions are not permanently interconnected and can be easily disassembled. A similar arrangement is shown in U.S. Pat. No. 5,735,144 for "Interconnectable Rings." In a different approach, U.S. Pat. No. 5,419,158 for a "Wrap Ring Assembly" discloses a pin assembly which is used to secure three ring portions at a common point along the circumference.

Other ring designs are disclosed in U.S. Pat. Nos. Des. 348,022 and Des. 421,405.

In certain instances, such as when two different metals are desired to effect a particular design, it is advantageous to utilize a method of mechanically interconnecting the metal pieces without welding or chemical bonding. The present invention provides a mechanical interconnection which permanently interconnects two or more pieces of an item of jewelry. For example two or more ring portions can be interconnected to obtain an aesthetically pleasing ring design.

SUMMARY OF THE INVENTION

The present invention is directed to an item of jewelry, such as a ring, having one or more ring portions mechanically interlinked or interconnected to form a single piece. Each ring portion includes a linking segment or mechanism which mates with a corresponding linking segment or mechanism on another ring portion. The ring portions are pressed together to permanently form a final aesthetically pleasing ring. Moreover, the ring portions, collectively, form the entire ring, i.e., both the inside surface as well as the outside surface.

In one embodiment of the invention, an item of jewelry in the form of a ring comprises a first generally circular ring portion having a first radially inward linking segment; and a second generally circular ring portion having a first radially outward linking segment. The first radially outward linking segment of the second ring portion is secured to the first radially inward linking segment of the first ring portion.

The first radially inward linking segment may comprise a groove formed in a radially outward surface of the radially inward linking segment. The groove is designed to mate with a tongue formation formed on a radially inward surface of the radially outward linking segment. When the first and second ring portions are pressed together, the tongue formation on the radially outward linking segment, in effect "snaps" into the groove of the radially inward linking segment to mechanically interconnect the two ring portions into a single ring.

The first radially inward linking segment of the first ring portion may extend 360 degrees about the first ring portion. In this embodiment, the first radially outward linking segment of the second ring portion would also extend 360 degrees about the second ring portion.

In an alternative embodiment the first ring portion may additionally comprise a first radially outward linking segment, a second radially inward linking segment, and a second radially outward linking segment. These segments would typically alternate around the circumference of the ring. In this embodiment, the second ring portion would further comprise a first radially inward linking segment which would be secured to the first radially outward linking segment of the first ring portion, a second radially outward linking segment which would be secured to the second radially inward linking segment of the first ring portion, and a second radially inward linking segment which would be secured to the second radially inward segment of the first ring portion. Additional corresponding linking segments can also be utilized.

In a further embodiment, the first radially inward linking segment of the first ring portion comprises a generally planar portion, or outer surface, inclined at a first angle with respect to a center axis of the first ring portion and a groove at one edge of the planar portion. Both the planar portion and the groove are formed on a radially outward surface of the first radially inward linking segment. The first radially outward linking segment of the second ring portion comprises a planar portion, or inward surface, inclined at a second angle with respect to a center axis of the ring portion and a tongue formation at one edge of the planar portion of the first radially outward linking segment. Both the planar portion of the first radially outward linking segment and the tongue formation are formed on a radially inward surface of the first radially outward linking segment. Although, described as "planar" portions (in that the surfaces are generally flat when viewed in cross-section), the inward and outward surfaces are arcuate because they follow the curve of the ring, and are more accurately described as conic sections (in instances in which the linking segment extends 360 degrees about the ring) or segments of a conic section (in instances in which the linking segment extends less than 360 degrees about the ring).

In another embodiment, the first ring portion can be formed from a first metal, and the second ring portion can be formed from a second metal different from the first metal. In one embodiment the first metal of the first ring portion is gold, and the second metal of the second ring portion is platinum. Alternatively, other precious metals or metal alloys may be used. Moreover, both the first and the second ring portions can be formed from the same metal.

In an alternative embodiment, the first radially inward linking segment of the first ring portion comprises a socket, and the first radially outward linking segment of the second ring portion comprises a ball formation.

In another embodiment, the ring comprises a gem (or other precious stone or pearl) lock-set between a first and second ring portion. In this embodiment, a first radially inward linking segment of a first ring portion includes a cutaway portion, and a first radially outward linking segment of a second ring portion also includes a cutaway portion. A gem is positioned and set in the space provided by the cutaway portion of the first radially inward linking segment and the cutaway portion of the first radially outward linking segment. The gem is trapped between the first ring portion and said second ring portion when the first and second ring portions are pressed together.

In an embodiment having alternating radially inward and outward linking segments, the linking segments can be generally rectangular. Additionally, other configurations are possible. For example, the linking segment may be generally triangular.

The present invention is also directed to a ring assembly comprising a first ring portion having a first radially inward linking segment, and a second ring portion having a first radially outward linking segment adapt to engage the first radially inward linking segment of the first ring portion. The ring portions can be sold apart, and can then be pressed together during a ceremony, such as a marriage, to symbolically represent a union of two people. When pressed together, the first ring portion will be mechanically interconnected to the second ring portion, and more particularly, the first radially inward linking segment of the first ring portion will be mechanically interconnected to the first radially outward linking segment of the second ring portion. Moreover, in this embodiment, the first ring portion may include a plurality of spaced apart radially inward linking segments disposed about the ring portion and a plurality of spaced apart radially outward linking segments, each of the radially outward linking segments positioned between radially inward linking segments.

In a still further embodiment, more than two ring portions can be interconnected to form a ring. In this embodiment a ring may comprise a first ring portion having a first linking segment and a diametrically opposed second linking segment, a second ring portion having a first linking segment secured to the first linking segment of the first ring portion; and a third ring portion having a first linking segment secured to the second linking segment of the first ring portion. The first linking segment of the first ring portion may be a radially inward segment, and the second linking segment of the first ring portion may also be a radially inward segment.

In a still further embodiment, the invention is directed to an item of jewelry comprising a first piece having a radially inward linking segment, and a second piece having a radially outward linking segment mechanically interconnected with the radially inward linking segment of said first piece. The item of jewelry may be an earring, cuff-link, pendant or other type of jewelry.

Further aspects of the present invention are described in the Brief Description of the Drawings, the Detailed Description of the Preferred Embodiment, the Abstract of the Invention, and are shown in the drawings.

DETAILED DESCRIPTION OF THE PREFERRED EMBODIMENT

Figure 1:
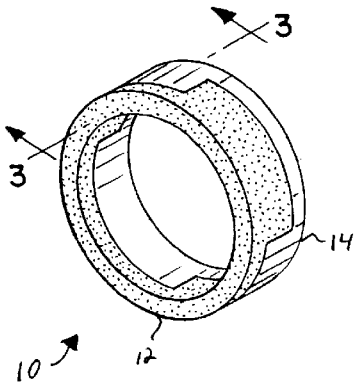
FIG. 1 is a perspective view of one embodiment of an interlocking ring combination having a first ring portion and a second ring portion made in accordance with the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

A ring 10 is formed from an assembly of ring portions which are designed to interlock into single item. As shown in FIG. 1, the ring 10 includes a first ring portion 12, and a second ring portion 14 mechanically interconnected with the first ring portion 12. Each ring portion 12, 14 is preferably formed from a precious metal, such as gold, white gold or platinum. Alternatively, the first and second ring portions 12, 14 can be formed from other precious metals, or metal alloys. Additionally, the first and second ring portions can be different metals (e.g., one ring portion is gold, the other is platinum), or made from the same type of metal (e.g., both ring portions are gold).

In the embodiment shown in FIG. 1, the first ring portion 12 is shaded differently than the second ring portion 14, to indicate that the first ring portion 12 is a different color, and therefore a different metal, than the second ring portion 14. Preferably, the first ring portion 12 is formed from a yellow gold, and the second ring portion 14 is formed from platinum. This gives the final ring 10 a unique alternating color pattern.

When different metals or alloys are desired for a particular ring design, the present invention has the added benefit of allowing such different metals or alloys to be easily combined or interconnected into a single finished ring product. This is because the interconnection (as explained in detail below) between the ring portions is mechanical. Thus, the ring artisan does not need to be concerned with whether two different metals or alloys will easily bond to each other (or to a third metal acting as a solder holding the different ring portions together), or with the cost in time and money in obtaining such bond. Further, the artisan does not need to be concerned with whether the extreme heat typically utilized to effect a bond between two metals (or solder), will adversely effect any gems or other material which may be inset in one or both of the ring portions. This ability to easily integrate two (or more, as explained below) metals into one ring, provides the ring artisan with a greater degree of freedom in creating ring designs.

Figure 2:
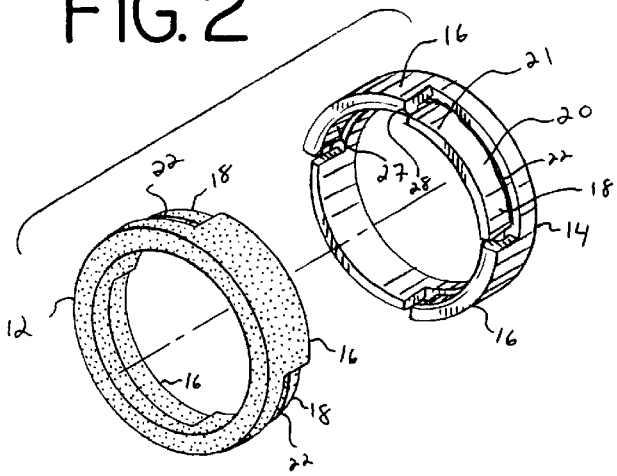
FIG. 2 is an exploded view of the interlocking ring combination of FIG. 1.

FIG. 2 shows the first and second ring portions 12, 14 in an exploded view prior to interconnection into a single ring. As is apparent in FIG. 2, the first and second ring portions 12, 14 are generally circular, and each portion 12, 14 is independently in the form of a ring shape. However, separately the ring portions 12, 14 are not as aesthetically pleasing as they are when interconnected.

The first and second ring portions 12, 14 include a plurality of radially (from the center of the ring) outward positioned linking segments 16, alternating with a plurality of radially inward positioned linking segments 18. The radially outward linking segments 16 are designed to interlink with the corresponding radially inward linking segments 18 to mechanically interconnect the two ring portions 12, 14.

As shown in FIGS. 1 and 2, each radially outward positioned linking segment 16 extends less than 360° about the circumference of the first and second ring portions 12, 14, respectively. Similarly, each radially inward positioned linking segment 18 extends less than 360° about the circumference of the first and second ring portions 12, 14, respectively. The outward positioned linking segments 16 alternate with the inward positioned linking segments 18.

The linking segments 16, 18 are preferably in the form of a tongue and groove formation which, in effect, are essentially snapped together to mechanically (i.e., in the sense of a purely physical connection, as opposed to a chemical bond or a soldered bond) interconnect the linking segments. Once connected, it is virtually impossible to separate the ring portions 12, 14 without harming or deforming the ring portions 1, 14.

Figure 3:
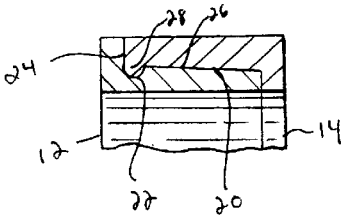
FIG. 3 is a cross-sectional view of the interlocking ring combination shown in FIG. 1.

Referring to FIGS. 2 and 3, the radially inward linking segment 18 includes a generally convex planar portion 20 (i.e., the portion 20 is generally "planar" in cross-section, however, because it follows the curve of the ring is more accurately described as a segment of a conic section) on its radially outward surface 21. The planar portion 20 is inclined at a slight angle with respect to the center axis of the ring portions 12, 14. A groove 22 is formed at one end of the planar portion 20 and a wall portion 24 extends from the other side of the groove 22.

The radially outward linking segment 16 includes a generally concave planar portion 26 (i.e., again, "planar" in cross-section, but more accurately described as a segment of a conic section) on its radially inward surface 27, which is also inclined at a slight angle with respect to the center axis of the ring portions 12, 14. A lip, or tongue formation 28, is formed at the end of the planar portion 26.

The angle of incline of the surfaces 21 and 27 will vary depending on the width of the linking segments and the flexibility of the particular metal used. Typically, the wider the linking segment, the smaller the angle.

When the radially outward linking segment 16 and the radially inward linking segment 18 are pressed together, the radially outward linking segment flares slight further radially outward until the tongue formation 28 is aligned with and fits into the groove 22. In this manner, the first and second ring portions 12, 14 are mechanically interconnected to form a single ring. That is, the connection between the first ring portion 12 and the second ring portion 14, is physical. There is no requirement for a chemical bond or a solder, to keep the two pieces together.

Furthermore, because the linking segments can extend around the entire circumference of the ring portions, the interconnection is secure and permanent. When interconnected, the two ring portions form the entire ring, both inside and outside, to have an aesthetically pleasing appearance. Such ring portions 12, 14 can be interconnected to form a wedding band, and may symbolically represent the joining to two people in marriage.

While the above preferred embodiment is described with each ring portion 12, 14 having two radially outward linking segments 16 alternating with two radially inward linking segments 18, other configurations are possible. For example, each ring portion may have three or more radially outward linking segments alternating with three or more radially inward linking segments. Moreover, in another example, the first ring portion may have a single radially inward linking segment 360 degrees about the first ring portion, and the second ring portion may have a corresponding single radially outward linking segment 360 degrees about the second ring portion.

The ring portions 12 and 14 can also be finished to have a generally rounded smooth surface, both outside and inside, rather than being "squared off" as shown in the Figures. Other typical formations may also be used.

Additionally, although the radially inward linking segment has been described as including a groove and the radially outward linking segment as having a tongue formation, this can be reversed. That is, the radially inward linking segment can be formed to include a tongue formation which mates with a groove in the corresponding radially outer linking segment.

Either before or after the assembly of the first ring portion 12 and the second ring portion 14 are interconnected into a final ring 10, the ring portions can be finished in any conventional manner. Possible finishes may include a high polish, brushed, satin, stone, sand-blast, or engraving (either by hand or machine).

Figure 4:
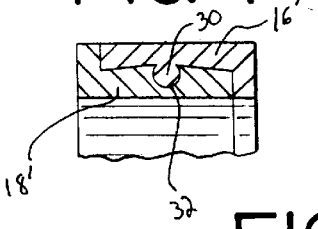
FIG. 4 is a cross-sectional view of an alternative linking arrangement of the present invention.
Figure 5:
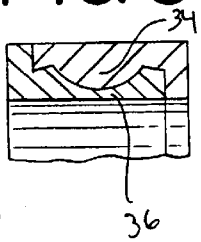
FIG. 5 is a cross-sectional view of a further alternative linking arrangement of the present invention.

A further embodiment of the linking segments is disclosed in cross-section in FIG. 4. Instead of the groove 22 and tongue formation 28 discussed above, a ball 30 and socket 32 arrangement may be used to mate a radially outward linking segment 16' with a radially inward linking segment 18'. In another alternative shown in FIG. 5, a dome 34 and divot formation 36 can be utilized. In fact, a variety of formations having a male extender portion which secures tightly within a female portion can be used to interconnect the ring portions.

Figure 6:
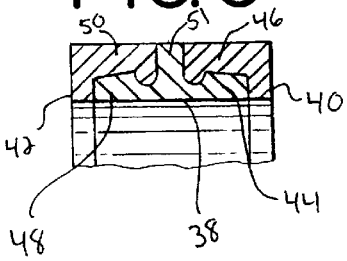
FIG. 6 is a cross-sectional view of an alternative embodiment of the present invention including three ring portions.

The present invention is not limited to interconnecting only two ring portions. Instead, three or more ring portions may be interconnected in a similar manner as described above. As shown in cross-section in FIG. 6, a first intermediate ring portion 38 can be interconnected to a second ring portion 40 on one side and to a third ring portion 42 on the opposite side diametrically opposed to the side connected to the second ring portion. In this embodiment, the first ring portion 38 includes a linking segment 44 on one side, to mate with a corresponding linking segment 46 in the second ring portion 40, and a linking segment 48 on its opposite side to mate with a corresponding linking segment 50 in the third ring portion 42. A central portion 51 of the intermediate ring portion 38, between the linking segments 44, 48 forms part of the outer surface of the final ring configuration.

The second or third ring portions 40, 42 may also include linking portions on opposite sides (to the sides connected to the first ring portion 38) to interconnect to additional ring portions. Additionally, similar to the interconnection between two ring portions, the linking segments between the first ring portion 38 and the second ring portion 40, and between the first ring portion 38 and the third ring portion 42, can be a plurality of alternating radially inward linking segments with radially outward linking segments. Alternatively, the same linking segment (e.g., a radially inward linking segment on both sides of the first ring portion 38, and a radially outward linking segment on the second and third ring portions 40, 42) can extend 360 degrees about the ring portions.

Figure 7:
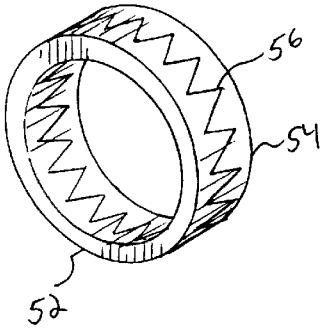
FIG. 7 is a perspective view of an alternative design of an interlocking ring combination having a first ring portion and a second ring portion made in accordance with the present invention.

The linking segments 16, 18 shown in FIGS. 1 and 2 are generally rectangular (albeit curved to follow the contours of the ring) in shape. However, other configurations are possible. Specifically, FIG. 7 shows a first ring portion 52 and a second ring portion 54 having a plurality of generally triangular shaped linking segments 56. In this embodiment, the groove and tongue formations would be formed along the sides of the triangle.

Figure 8:
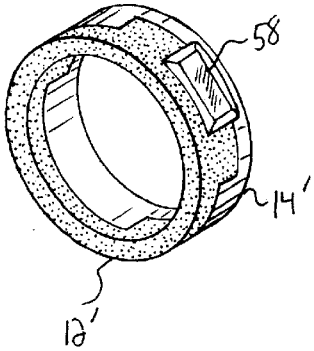
FIG. 8 is a perspective view of an interlocking ring combination having a first ring portion, a second ring portion, and a gem trapped between the first ring portion and the second ring portion.
Figure 9:
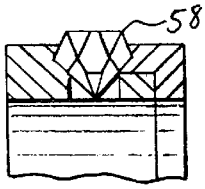
FIG. 9 is a cross-sectional view of the interlocking ring combination of FIG. 8 showing the gem trapped between the first ring portion and the second ring portion.

The present invention can also be used to lock-set a gem or other stone into a ring 10'. As shown in FIGS. 8 and 9, a gem 58 is locked between a first ring portion 12' and a second ring portion 14'. Each ring portion 12', 14' includes a segment which is cut-away to allow placement of the gem 58 within a portion of corresponding linking segments. As long as metal is above and below the girdle of the gem 58 (if faceted), the gem 58 will be set when the first ring portion 12' and the second ring portion 14' are pressed together to form the final ring 10'.

This procedure has the added benefit of avoiding the problems associated with channel setting which typically requires hammering the channel with the stone in the channel. Instead, a stone or other inset item, can be calibrated, and set upon closing of the ring portions without hammering the channel. Accordingly, insets which may normally be damaged by channel setting, such as opals, pearls, emeralds, can be easily set in the present invention without risk of damage.

The prototype model of the ring shown in FIGS. 1 through 3 was formed from a lost wax cast method. However, machine carving can be used for mass production. A first machine can be used to extrude metal tubes in various diameters in order to manufacture different ring sizes. A second "carving" machine can be used to form the linking segments in the ring portions. The second machine can be laser driven to cut the metal tubes into the specific configurations required.

The present invention is not limited to rings. The interlocking or interconnecting mechanism described above is applicable to other items of jewelry having one or more portions, such as for example brooches, cuff-links, pendants, earrings, jackets or ring guards.

I claim:

1. An item of jewelry in the form of a ring comprising;

a first generally circular ring portion having a first radially inward linking segment adjacent the inner circumference of said first generally circular ring portion and extending partway toward the outer circumference of said first generally circular ring portion; said first radially inward linking segment extending less than 360° about said inner circumference of said first generally circular ring portion, and a second generally circular ring portion having a first radially outward linking segment adjacent the outer circumference of said second generally circular ring portion and extending partway toward the inner circumference of said second generally circular ring portion, said first radially outward linking segment extending less than 360° about said outer circumference of said second generally circular ring portion, said first radially outward linking segment of said second ring portion permanently directly and non-rotatably secured to said first radially inward linking segment of said first ring portion.

2. The ring of claim 1 wherein said first radially inward linking segment comprises a groove formed in a radially outward surface of said radially inward linking segment.

3. The ring of claim 2 wherein said first radially outward linking segment comprises a tongue formation on a radially inward surface of said radially outward linking segment.

4. The ring of claim 3 wherein said first ring portion further comprises a first radially outward linking segment, a second radially inward linking segment, and a second radially outward linking segment.

5. The ring of claim 4 herein said second ring portion further comprises a first radially inward linking segment secured to said first radially outward linking segment of said first ring portion, a second radially outward linking segment secured to said second radially inward linking segment of said first ring portion, and a second radially inward linking segment secured to said second radially outward segment of said first ring portion.

6. The ring of claim 5 wherein said first and second radially outward linking segments of said first ring portion are generally rectangular.

7. The ring of claim 5 wherein said first and second radially outward linking segments of said first ring portion are generally triangular.

8. The ring of claim 1 wherein said first radially inward linking segment of said first ring portion comprises a planar portion inclined at a first angle with respect to a center axis of said first ring portion and a groove at one edge of said planar portion, both said planar portion and said groove formed on a radially outward surface of said first radially inward linking segment.

9. The ring of claim 8 wherein said first radially outward linking segment of said second ring portion comprises a planar portion inclined at a second angle with respect to a center axis of said second ring portion and a tongue formation at one edge of said planar portion of said first radially outward linking segment, both said planar portion of said first radially outward linking segment and said tongue formation formed on a radially inward surface of said first radially outward linking segment.

10. The ring of claim 1 wherein said first ring portion is formed from a first metal, and said second ring portion is formed from a second metal different from said first metal.

11. The ring of claim 10 wherein said first metal of said first ring portion is gold.

12. The ring of claim 11 wherein said second metal of said second ring portion is platinum.

13. The ring of claim 1 wherein said first radially inward linking segment of said first ring portion comprises a socket.

14. The ring of claim 13 wherein said first radially outward linking segment of said second ring portion comprises a ball formation.

15. The ring of claim 1 further comprising said first radially inward linking segment of said first ring portion including a cutaway portion, said first radially outward linking segment of said second ring portion including a cutaway portion, a gem positioned in said cutaway portion of said first radially inward linking segment and said cutaway portion of said first radially outward linking segment, said gem trapped between said first ring portion and said second ring portion.

16. A ring assembly comprising a first ring portion having a first radially inward linking segment adjacent the inner circumference of said first ring portion and extending partway toward the outer circumference of said first ring portion, said first radially inward linking segment extending less than 360° about said inner circumference of said first ring portion; and a second ring portion having a first radially outward linking segment adjacent the outer circumference of said second ring portion and extending partway toward the inner circumference of said second ring portion adapted to non-rotatably abut said first radially inward linking segment of said first ring portion, said first radially outward linking segment extending less than 360° about said outer circumference of said second ring portion.

17. The ring assembly of claim 16 wherein said first ring portion includes a plurality of spaced apart radially inward linking segments disposed about said first ring portion and a plurality of spaced apart radially outward linking segments disposed about said first ring portion, each of said radially outward linking segments disposed about said first ring portion positioned between said radially inward linking segments positioned about said first ring portion.

18. The ring assembly of claim 16 wherein said first radially inward linking segment of said first ring portion is mechanically interconnected to said first radially outward linking segment.

19. An item of jewelry in the form of a ring comprising a first ring portion having a first linking segment adjacent the inner circumference of said first ring portion and extending partway toward the outer circumference of said first ring portion, and a diametrically opposed second linking segment adjacent said inner circumference of said first ring portion and extending partway toward said outer circumference of said first ring portion, said first linking segment extending less than 360° about said inner circumference of said first ring portion and said second linking segment extending less than 360° about said inner circumference of said first ring portion;

a second ring portion having a first linking segment adjacent the outer circumference of said second ring portion and extending partway toward the inner circumference of said second ring portion, said first linking segment of said second ring portion non-rotatably abutting and secured to said first linking segment of said first ring portion; and a third ring portion having a first linking segment adjacent the outer circumference of said third ring portion and extending partway toward the inner circumference of said third ring portion, said first linking segment of said third ring portion non-rotatably abutting and secured to said second linking segment of said first ring portion.

20. The ring of claim 19 wherein said first linking segment of said first ring portion is a radially inward segment, and said second linking segment of said first ring portion is a radially inward segment.

21. An item of jewelry comprising a first piece having a radially inward linking segment, said radially inward linking segment extending less than 360° about a circumference of said first piece, said first radially inward linking segment having a radially outward cutaway portion; and a second piece having a radially outward linking segment having a radially inward cutaway portion, said radially outward linking segment mechanically interconnected with and non-rotatably secured to said radially inward linking segment of said first piece, said radially outward linking segment extending less than 360° about a circumference of said second piece.

* * * * *